US008957368B2

(12) United States Patent
Kenny

(10) Patent No.: US 8,957,368 B2
(45) Date of Patent: Feb. 17, 2015

(54) ION TUNNEL ION GUIDE

(71) Applicant: Micromass UK Limited, Wilmslow (GB)

(72) Inventor: Daniel James Kenny, Knutsford (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/187,613

(22) Filed: Feb. 24, 2014

(65) Prior Publication Data

US 2014/0166895 A1 Jun. 19, 2014

Related U.S. Application Data

(63) Continuation of application No. 13/375,076, filed as application No. PCT/GB2010/001076 on May 28, 2010, now Pat. No. 8,658,970.

(60) Provisional application No. 61/182,132, filed on May 29, 2009.

(30) Foreign Application Priority Data

May 29, 2009 (GB) ..... 0909292.5

(51) Int. Cl.

| | |
|---|---|
| ***H01J 49/04*** | (2006.01) |
| ***H01J 49/06*** | (2006.01) |
| ***H01J 49/42*** | (2006.01) |
| ***H01J 49/02*** | (2006.01) |

(52) U.S. Cl.

CPC ..... *H01J 49/062* (2013.01); *H01J 49/422* (2013.01); *H01J 49/02* (2013.01)

USPC ..... 250/283; 250/292; 250/396 R

(58) Field of Classification Search

CPC ..... H01J 49/26

USPC ..... 250/283

See application file for complete search history.

(56) References Cited

U.S. PATENT DOCUMENTS

| | | | | |
|---|---|---|---|---|
| 6,015,972 | A | 1/2000 | Hager | |
| 6,794,641 | B2 * | 9/2004 | Bateman et al. | 250/281 |
| 6,911,650 | B1 | 6/2005 | Park | |
| 7,198,353 | B2 | 4/2007 | Hart et al. | |
| 7,227,137 | B2 | 6/2007 | Londry et al. | |
| 8,519,331 | B2 | 8/2013 | Bateman et al. | |
| 2003/0173524 | A1 | 9/2003 | Syka | |
| 2004/0211897 | A1 | 10/2004 | Kim et al. | |
| 2006/0016981 | A1 | 1/2006 | Park | |
| 2007/0272848 | A1 | 11/2007 | Franzen | |
| 2009/0134321 | A1 * | 5/2009 | Hoyes | 250/282 |
| 2011/0057097 | A1 * | 3/2011 | Bateman et al. | 250/283 |

FOREIGN PATENT DOCUMENTS

| | | |
|---|---|---|
| EP | 2124246 | 11/2009 |
| GB | 2418528 | 3/2006 |
| GB | 2423863 | 9/2006 |
| GB | 2454762 | 5/2009 |

(Continued)

*Primary Examiner* — Phillip A Johnston

(74) *Attorney, Agent, or Firm* — Diederiks & Whitelaw, PLC

(57) ABSTRACT

An ion guide is disclosed comprising a plurality of axial groupings of electrodes, wherein each axial grouping of electrodes comprises a ring or annular electrode which has been radially segmented into a plurality of electrode segments.

9 Claims, 6 Drawing Sheets

(56) References Cited

FOREIGN PATENT DOCUMENTS

| | | |
|---|---|---|
| GB | 2465067 | 5/2010 |
| WO | WO 2004010209 | 11/2004 |
| WO | WO 2005067000 | 7/2005 |
| WO | WO 2007010272 | 1/2007 |
| WO | WO 2008129751 | 10/2008 |
| WO | WO 2009110025 | 9/2009 |
| WO | WO 2010141776 | 12/2010 |

* cited by examiner

ION TUNNEL ION GUIDE

CROSS REFERENCE TO RELATED APPLICATIONS

This application is a continuation of U.S. patent application Ser. No. 13/375,076 filed Nov. 29, 2011 which is the National Stage of International Application No. PCT/GB2010/001076 filed May 28, 2010 which claims priority to and benefit of U.S. Provisional Patent Application Ser. No. 61/182,132 filed on 29 May 2009 and United Kingdom Patent Application No. 0909292.5 filed on 29 May 2009. The entire contents of these applications are incorporated herein by reference.

BACKGROUND OF THE INVENTION

The present invention relates to an ion guide, a mass spectrometer, a method of guiding ions and a method of mass spectrometry.

It is well known that the time averaged force on a charged particle or ion due to an AC inhomogeneous electric field is such as to accelerate the charged particle or ion to a region where the electric field is weaker. A minimum in the electric field is commonly referred to as a pseudo-potential well or valley. Correspondingly, a maximum is commonly referred to as a pseudo-potential hill or barrier. RF ion guides are designed to exploit this phenomenon by causing a pseudo-potential well to be formed along the central axis of the ion guide so that ions are confined radially within the ion guide.

Different forms of AC or RF ion guide are known including those constructed using multi-pole rod sets, for example quadrupole, hexapole and octapole rod sets. Also known are ion tunnel or stacked ring ion guides which comprise a stacked ring electrode set wherein opposite phases of an AC or RF voltage are applied to adjacent electrodes. A further known ion guide comprises a series of diametrically opposed AC or RF plate electrodes with DC top and bottom plates, otherwise known as a sandwich-plate ion guide.

A quadrupole rod set ion guide generates a radially symmetric quadrupolar field. To obtain a perfect field it is necessary for the rods to have a hyperbolic cross section. Other types of rod may be used to approximate a quadrupolar field. For example, circular rods, concave rods and flat rods may be used. Quadrupole rod sets are often used for analytical devices such as quadrupole mass filters, linear ion traps and other similar devices. However, their restricted stable mass range and poor acceptance can restrict their use as an ion transport device.

Ion tunnel ion guides have a wide mass range and their flat bottomed/steep sided pseudo-potential leads to good acceptance and transmission characteristics.

It is desired to provided an improved ion guide.

SUMMARY OF THE INVENTION

According to an aspect of the present invention there is provided an ion guide comprising a plurality of axial groupings of electrodes, wherein each axial grouping of electrodes comprises a ring or annular electrode which has been radially segmented into a plurality of electrode segments.

Each axial grouping of electrodes preferably comprises a plurality of generally quadrant, sextant or octant shaped electrode segments. Other embodiments are contemplated wherein the electrode segments may have different shapes.

According to another aspect of the present invention there is provided an ion guide comprising a plurality of axial groupings of electrodes, wherein each axial grouping of electrodes preferably comprises a plurality of electrode segments wherein in a first mode of operation ions are confined radially within the ion guide by a non-quadrupolar radial, pseudo-potential well and wherein in a second mode of operation ions are confined radially within the ion guide by a substantially quadrupolar radial pseudo-potential well.

The non-quadrupolar radial pseudo-potential well may, for example, have a profile similar to that of an ion tunnel ion guide i.e. a relatively flat bottomed/steep sided pseudo-potential well.

The quadrupolar radial pseudo-potential well is particularly advantageous in that ions can be resonantly excited out of the ion guide in the radial direction in a mode of operation.

In the first mode of operation most, or all the electrode segments in first and/or third and/or fifth and/or seventh (i.e. odd numbered) axial groupings of electrodes are preferably maintained at substantially the same first phase of a first AC or RF voltage.

In the first mode of operation most or all the electrode segments in second and/or fourth and/or sixth and/or eighth (i.e. even numbered) axial groupings of electrodes are preferably maintained at substantially the same second phase of the first AC or RF voltage.

According to the preferred embodiment:

(a) the second phase is different to the first phase; and/or (b) the phase difference between the first phase and the second phase is substantially 180°.

Other embodiments are contemplated wherein the phase difference between the first phase and the second phase is selected from the group consisting of (i) 0-10°; (ii) 10-20°; (iii) 20-30°; (iv) 30-40°; (v) 40-50°; (vi) 50-60°; (vii) 60-70°; (viii) 70-80°; (ix) 80-90°; (x) 90-100°; (xi) 100-110°; (xii) 110-120°; (xiii) 120-130°; (xiv) 130-140°; (xv) 140-150°; (xvi) 150-160°; (xvii) 160-170°; and (xviii) 170-180°.

According to an embodiment:

(i) the first axial grouping of electrodes is axially adjacent the second axial grouping of electrodes; and (ii) the second axial grouping of electrodes is axially adjacent the third axial grouping of electrodes;

(iii) the third axial grouping of electrodes is axially adjacent the fourth axial grouping of electrodes;

(iv) the fourth axial grouping of electrodes is axially adjacent the fifth axial grouping of electrodes;

(v) the fifth axial grouping of electrodes is axially adjacent the sixth axial grouping of electrodes;

(vi) the sixth axial grouping of electrodes is axially adjacent the seventh axial grouping of electrodes; and (vii) the seventh axial grouping of electrodes is axially adjacent the eighth axial grouping of electrodes, According to the preferred embodiment odd-numbered axial groupings of electrodes are preferably interleaved with even-numbered axial groupings of electrodes.

According to an embodiment in the second mode of operation one or more or a pair of electrode segments in the first and/or second and/or third and/or fourth and/or fifth and/or sixth and/or seventh and/or eighth axial groupings of electrodes are maintained at substantially the same first phase of the first AC or RF voltage and wherein one or more or a pair of electrode segments in the first and/or second and/or third and/or fourth and/or fifth and/or sixth and/or seventh and/or eighth axial groupings of electrodes are maintained at substantially the same second phase of the first AC or RF voltage.

According to the preferred embodiment in the second mode of operation odd-numbered electrode segments are maintained at the same first phase of the first AC or RF voltage and even-numbered electrode segments are maintained at the same second different phase of the first AC or RF voltage.

Other embodiments are contemplated wherein in a mode of operation first and fourth electrode segments in some or all axial groupings of electrodes are maintained at the same first phase of an AC or RF voltage, second and fifth electrode segments in some or all axial groupings of electrodes are maintained at the same second phase of an AC or RF voltage, and third and fourth electrode segments in some or all axial groupings of electrodes are maintained at the same third phase of an AC or RF voltage.

Another embodiment is contemplated wherein in a mode of operation first and fifth electrode segments in some or all axial groupings of electrodes are maintained at the same first phase of an AC or RF voltage, second and sixth electrode segments in some or all axial groupings of electrodes are maintained at the same second phase of an AC or RF voltage, third and seventh electrode segments in some or all axial groupings of electrodes are maintained at the same third phase of an AC or RF voltage, and fourth and eighth electrode segments in some or all axial groupings of electrodes are maintained at the same fourth phase of an AC or RF voltage.

Embodiments of the present invention are contemplated wherein the electrode segments in an axial grouping of electrodes may be maintained at two, three, four, five, six, seven, eight, nine, ten or more than ten different phases.

According to an embodiment in the second mode of operation:

(a) the second phase is different to the first phase; and/or (b) the phase difference between the first phase and the second phase is substantially 180°.

Embodiments are also contemplated wherein in the second mode of operation the phase difference between the first phase and the second phase is selected from the group consisting of (i) 0-10°; (ii) 10-20°; (iii) 20-30°; (iv) 30-40'; (s) 40-50°; (vi) 50-60°; (vii) 60-70°; (viii) 70-80°; (ix) 80-90°; (x) 90-100°; (xi) 100-110°; (xii) 110-120°; (xiii) 120-130°; (xiv) 130-140°; (xv) 140-150°; (xvi) 150-160°; (xvii) 160-170°; and (xviii) 170-180°.

According to an embodiment in the second mode of operation non adjacent electrode segments in the first and/or second and/or third and/or fourth and/or fifth and/or sixth and/or seventh and/or eighth axial groupings of electrodes are maintained at either the same first phase of the first AC or RF voltage or the same second phase of the first AC or RF voltage.

Preferably, at least some or all of the electrode segments comprise electrodes having a generally, quadrant, sextant, octant, planar, rectangular, square, circular, hyperbolic or wedge shape. Other embodiments are contemplated wherein the electrode segments may have different shapes.

According to an aspect of the present invention there is provided an ion guide comprising a plurality of axial groupings of electrodes, wherein each axial grouping of electrodes comprises at least a first, second, third and fourth electrode segment wherein in a mode of operation;

(a) first and second electrode segments in a first and/or third and/or fifth and/or seventh axial grouping are maintained at substantially the same first phase of a first RF voltage; and (b) corresponding first and second electrode segments in a second and/or fourth and/or sixth and/or eighth axial grouping are maintained at substantially the same second phase of the first RF voltage; and (c) wherein third and fourth electrode segments in the first and/or second and/or third and/or fourth and/or fifth and/or sixth and/or seventh and/or eighth axial groupings are maintained at substantially the same first DC voltage.

According to this embodiment the ion guiding profile within the ion guide may be substantially similar to that of an ion guide comprising a plurality of planar electrodes arranged generally in the plane of ion travel wherein adjacent planar electrodes are preferably maintained at opposite phases of an AC or RF voltage.

According to an embodiment:

(a) the second phase is different to the first phase; and/or (b) the phase difference between the first phase and the second phase is substantially 180°; or (c) the phase difference between the first phase and the second phase is selected from the group consisting of: (i) 0-10°; (ii) 10-20°; (iii) 20-30"; (iv) 30-40°; (v) 40-50°; (vi) 50-60°; (vii) 60-70°; (viii) 70-80°; (ix) 80-90°; (x) 90-100'; (xi) 100-110°; (xii) 110-120°; (xiii) 120-130°; (xiv) 130-140°; (xv) 140-150°; (xvi) 150-160'; (vii) 160-170°; and (xviii) 170-180°.

Preferably:

(i) the first axial grouping of electrodes is axially adjacent the second axial grouping of electrodes; and (ii) the second axial grouping of electrodes is axially adjacent the third axial grouping of electrodes;

(iii) the third axial grouping of electrodes is axially adjacent the fourth axial grouping of electrodes;

(iv) the fourth axial grouping of electrodes is axially adjacent the fifth axial grouping of electrodes;

(v) the fifth axial grouping of electrodes is axially adjacent the sixth axial grouping of electrodes;

(vi) the sixth axial grouping of electrodes is axially adjacent the seventh axial grouping of electrodes; and (vii) the seventh axial grouping of electrodes is axially adjacent the eighth axial grouping of electrodes.

According to another aspect of the present invention there is provided an ion guide comprising a plurality of axial groupings of electrodes, wherein each axial grouping of electrodes comprises a ring or annular electrode which has been radially segmented into a plurality of electrode segments, wherein in a first mode of operation ions are not confined axially within the ion guide and wherein in a second mode of operation ions are confined axially within the ion guide.

According to this embodiment an RF voltage may be applied to an exit region of the ion guide in the second mode of operation in order to provide a mass to charge ratio dependent potential (pseudo-potential) barrier.

According to the preferred embodiment during the first mode of operation the phase of an RF voltage applied to at least one, two, three or four electrode segments in a first and/or second and/or third and/or fourth and/or fifth and/or sixth and/or seventh and/or eighth axial grouping of electrodes may be altered or swapped in order to vary the ion transmission characteristics of the ion guide.

For example, during the first mode of operation ions may be confined radially within the ion guide by a radial pseudo-potential well wherein the profile of the radial pseudo-potential well may be switched between, for example, a quadrupolar radial pseudo-potential well and a non-quadrupolar radial pseudo-potential well during the first mode of operation. Other embodiments are contemplated wherein the radial pseudo-potential well may be switched between a flat bottomed/steep sides pseudo-potential well a quadrupolar pseudo-potential well a hexapolar pseudo-potential well, an octopolar pseudo-potential well or a pseudo-potential well having a different profile.

According to an embodiment some or all axial groupings of electrodes may comprise 2, 3, 4, 5, 6, 7, 8, 9, 10, 11, 12, 13, 14, 15, 16, 17, 18, 19, 20 or >20 electrode segments.

The electrode segments in an axial grouping of electrodes are preferably:

(a) disposed around a central ion guiding region along which ions are transmitted in use; and/or (b) guide ions along one or more axial ion pathways; and/or (c) have a profile which varies along the axial length of the ion guide.

According to an embodiment the ion guide may have a profile such that ions are funnelled from a relatively broad ion accepting region into a relatively well defined ion guiding region thereby enabling the onward transmission of ions to be maximised or optimised.

According to an embodiment the ion guide may comprise 1, 2, 3, 4-10, 10-15, 15-20, 20-25, 25-30, 30-35, 35-40, 40-45, 45-50, 50-55, 55-60, 60-65, 65-70, 70-75, 75-80, 80-85, 85-90, 90-95, 95-100 or >100 axial groupings of electrodes.

Preferably, at least some or all of the electrode segments in an axial grouping of electrodes can be maintained at different electrical potentials relative to each other.

According to another aspect of the present invention there is provided an ion guide comprising a plurality of ring or annular electrodes wherein:

in a first mode of operation axially adjacent electrodes are maintained at substantially opposite phases of an RF voltage; and wherein in a second mode of operation the phase of a pair of axially adjacent electrodes is switched so that two axially adjacent electrodes are maintained at substantially the same first phase and two further axially adjacent electrodes are maintained at substantially the same second phase, wherein the first phase is different to the second phase.

Other embodiments are contemplated wherein the phase of at least one electrode is altered so that, for example, the phase difference between two axially adjacent electrodes is neither 0° nor 180°.

According to another aspect of the present invention there is provided an ion guide comprising a plurality of axial groupings of electrodes, wherein each axial grouping of electrodes a plurality of electrode segments wherein:

in a first mode of operation axially adjacent axial groupings of electrodes are maintained at substantially opposite phases of an RF voltage; and wherein in a second mode of operation the phase of a pair of axially adjacent axial groupings of electrodes is switched or altered so that two axially adjacent axial groupings of electrodes are maintained at substantially the same first phase and to further axially adjacent axial groupings of electrodes are maintained at substantially the same second phase, wherein the first phase is different to the second phase.

Other embodiments are contemplated wherein the phase of an axial grouping of electrodes may be altered so that, for example, the phase difference between two axially adjacent axial groupings of electrodes is neither 0° nor 180°.

According to an embodiment:

(a) the ion guide is arranged and adapted to be maintained at a pressure selected from the group consisting of (i) <1000 mbar; (ii) <100 mbar, (iii) <10 mbar; (iv) <1 mbar; (v) <0.1 mbar; (vi) <0.01 mbar; (vii) <0.001 mbar; (viii) <0.0001 mbar; and (ix) <0.00001 mbar; and/or (b) the ion guide is arranged and adapted to be maintained at a pressure selected from the group consisting of (i) >1000 mbar; (ii) >100 mbar; (iii) >10 mbar; (iv) >1 mbar; (v) >0.1 mbar; (vi) >0.01 mbar; (vii) >0.001 mbar; and (viii) >0.0001 mbar and/or (c) the ion guide is arranged and adapted to be maintained at a pressure selected from the group consisting of: (i) 0.0001-0.001 mbar; (ii) 0.001-0.01 mbar; (iii) 0.01-0.1 mbar; (iv) 0.1-1 mbar; (v) 1-10 mbar; (vi) 10-100 mbar; and (vii) 100-1000 mbar.

According to a particularly preferred embodiment of the present invention the ion guide may be operated at a pressure below that at which ion mobility separation is substantially observed. For example, the ion guide may be operated at a pressure $<10^{-3}$ mbar so that ions are not separated according to their ion mobility as they are transmitted along and through the on guide.

According to an embodiment of the present invention the ion guide may be operated in a mode of operation wherein ions are not substantially separated according to their ion mobility as they are transmitted along and through the ion guide.

According to an aspect of the present invention there is provided an ion mobility spectrometer or separator comprising an ion guide as described above, wherein in a mode of operation:

(i) ions are arranged to separate temporally according to their ion mobility; and/or (ii) ions are arranged to separate temporally according to their rate of ion mobility change with electric field strength.

According to an aspect of the present invention there is provided an ion trap or mass analyser comprising an ion guide as described above.

According to an aspect of the present invention there is provided a mass spectrometer comprising an ion guide as described above or an ion mobility spectrometer or separator as described above or an ion trap or mass analyser as described above.

The mass spectrometer preferably further comprises either:

(a) an ion source arranged upstream of the ion guide, wherein the ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption ionisation ("MALDI") ion source; (v) a Laser Desorption Ionisation ("LDI") ion source; (vi) an Atmospheric Pressure ionisation ("API") ion source; (iii) a Desorption Ionisation on Silicon ("DIOS") OD source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more further ion guides arranged upstream and/or downstream of the ion guide; and/or (d) one or more ion mobility separation devices and/or one or more Field Asymmetric Ion Mobility Spectrometer devices arranged upstream and/or downstream of the ion guide; and/or (e) one or more ion traps or one or more ion trapping regions arranged upstream and/or downstream of the ion guide; and/or (f) one or more collision, fragmentation or reaction cells arranged upstream and/or downstream of the ion guide, wherein the one or more collision, fragmentation or reaction cells are selected from the group consisting of (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation, device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation, device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions: (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers arranged upstream and/or downstream of the ion guide; and/or (i) one or more ion detectors arranged upstream and/or downstream of the ion guide; and/or (j) one or more mass filters arranged upstream and/or downstream of the ion guide, wherein the one or more mass filters are selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions into the ion guide; and/or (l) a device for converting a substantially continuous ion beam into a pulsed ion beam.

The mass spectrometer preferably further comprises:

(i) a C-trap; and a mass analyser comprising an outer barrel-like electrode and a coaxial inner spindle-like electrode; wherein in a first mode of operation ions are transmitted to the C-trap and are then injected, into the mass analyser; and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected, into orbitrap mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to another aspect of the present invention there is provided a method of guiding ions comprising:

providing an ion guide comprising a plurality of axial groupings of electrodes, wherein each axial grouping of electrodes comprises a ring or annular electrode which has been radially segmented into a plurality of electrode segments; and guiding ions along the ion guide.

According to another aspect of the present invention there is provided a method of guiding ions comprising:

providing an ion guide comprising a plurality of axial groupings of electrodes, wherein each axial grouping of electrodes comprises a plurality of electrode segments:

operating the ion guide in a first mode of operation wherein ions are confined radially within the ion guide by a non-quadrupolar radial pseudo-potential well; and operating the ion guide in a second mode of operation wherein ions are confined radially within the ion guide by a substantially quadrupolar radial pseudo-potential well.

According to another aspect of the present invention there is provided a method of guiding ions comprising:

providing an ion guide comprising a plurality of axial groupings of electrodes, wherein each axial grouping of electrodes comprises at least a first, second, third and fourth electrode segment;

maintaining first and second electrode segments in a first and/or third and/or fifth and/or seventh axial grouping at substantially the same first phase of a first RF voltage;

maintaining corresponding first and second electrode segments in a second and/or fourth and/or sixth and/or eighth axial grouping at substantially the same second phase of the first RF voltage; and maintaining third and fourth electrode segments in the first and/or second and/or third and/or fourth and/or fifth and/or sixth and/or seventh and/or eighth axial grouping at substantially the same first DC voltage.

According to another aspect of the present invention there is provided a method of guiding ions comprising:

providing an ion guide comprising a plurality of axial groupings of electrodes, wherein each axial grouping of electrodes comprises a ring or annular electrode which has been radially segmented into a plurality of electrode segments;

operating the ion guide in a first mode of operation wherein ions are not confined axially within the ion guide; and operating the ion guide in a second mode of operation ions are confined axially within the ion guide.

According to another aspect of the present invention there is provided a method of guiding ions comprising:

providing an ion guide comprising a plurality of ring or annular electrodes;

operating the ion guide in a first mode of operation wherein axially adjacent electrodes are maintained at substantially opposite phases of an RF voltage; and operating the ion guide in a second mode of operation wherein the phase of a pair of axially adjacent electrodes is switched so that two axially adjacent electrodes are maintained at substantially the same first phase and two further axially adjacent electrodes are maintained at substantially the same second phase, wherein the first phase is different to the second phase.

According to another aspect of the present invention there is provided a method of guiding ions comprising:

providing an ion guide comprising a plurality of axial groupings of electrodes, wherein each axial grouping of electrodes a plurality of electrode segments;

operating the ion guide in a first mode of operation wherein axially adjacent axial groupings of electrodes are maintained at substantially opposite phases of an RF voltage; and operating the ion guide in a second mode of operation wherein the phase of a pair of axially adjacent axial groupings of electrodes is switched so that two axially adjacent axial groupings of electrodes are maintained at substantially the same first phase and two further axially adjacent axial groupings of electrodes are maintained at substantially the same second phase, wherein the first phase is different to the second phase.

According to another aspect of the present invention there is provided an ion guide comprising a plurality of electrodes wherein:

in a first mode of operation first electrodes are maintained at a first phase of an RF voltage and second electrodes are maintained at a second different phase of the RF voltage; and wherein in a second mode of operation the phase of one or more electrodes is altered, varied or switched.

According to another aspect of the present invention there is provided an ion trap comprising a plurality of electrodes wherein:

in a first mode of operation first electrodes are maintained at a first phase of an RF voltage and second electrodes are maintained at a second different phase of the RF voltage; and wherein in a second mode of operation the phase of one or more electrodes is altered, varied or switched.

According to another aspect of the present invention there is provided a method of guiding ions comprising:

providing an ion guide comprising a plurality of electrodes;

maintaining first electrodes at a first phase of an RF voltage and second electrodes at to second different phase of the RF voltage; and altering, varying or switching the phase of one or more electrodes.

According to another aspect of the present invention there is provided a method of trapping ions comprising:

providing an ion trap comprising a plurality of electrodes;

maintaining first electrodes at a first phase of an RF voltage and second electrodes at a second different phase of the RF voltage; and altering, varying or switching the phase of one or more electrodes.

According to another aspect of the present invention there is provided an ion guide and/or ion trap comprising a plurality of axial groupings of electrodes, wherein each axial grouping of electrodes comprises a plurality of electrode segments wherein:

in a first mode of operation ions are confined radially within the ion guide by a first radial pseudo-potential well having a first profile and wherein in a second mode of operation ions are confined radially within the ion guide by a second radial pseudo-potential well having a second different profile.

The first profile is preferably selected from the group consisting of: (i) a quadrupolar profile; (ii) a hexapolar profile; (iii) an octopolar profile.

The second profile is selected from the group consisting of (i) a quadrupolar profile, (ii) a hexapolar profile; (iii) an octopolar profile.

According to another aspect of the present invention there is provided a method of guiding ions and/or trapping ions comprising:

providing an ion guide and/or ion trap comprising a plurality of axial groupings of electrodes, wherein each axial grouping of electrodes comprises a plurality of electrode segments;

operating the ion guide and/or ion trap in a first mode of operation wherein ions are confined radially within the ion guide by a first radial pseudo-potential well having a first profile; and operating the ion guide and/or ion trap in a second mode of operation wherein ions are confined radially within the ion guide by a second radial pseudo-potential well having a second different profile.

According to another aspect of the present invention there is provided a computer program executable by the control system of a mass spectrometer comprising an ion guide comprising a plurality of axial groupings of electrodes, wherein each axial grouping of electrodes comprises a ring or annular electrode which has been radially segmented into a plurality of electrode segments, the computer program being arranged to cause the control system:

to guide ion through the ion guide.

According to another aspect of the present invention there is provided a computer program executable by the control system of a mass spectrometer comprising an ion guide comprising a plurality of axial groupings of electrodes, wherein each axial grouping of electrodes comprises a plurality of electrode segments, the computer program being arranged to cause the control system:

(i) to operate the ion guide in a first mode of operation wherein ions are confined radially within the ion guide by a non-quadrupolar radial pseudo-potential well; and (ii) to operate the ion guide in a second mode of operation wherein ions are confined radially within the ion guide by a substantially quadrupolar radial pseudo-potential well.

According to other aspects of the present invention a computer program executable by the control system of a mass spectrometer may be provided wherein the computer program is arranged to cause the control system to implement one or more of the preferred methods are described above.

According to another aspect of the present invention there is provided a computer readable medium comprising computer executable instructions stored on the computer readable medium, the instructions being arranged to be executable by a control system of a mass spectrometer comprising a plurality of axial groupings of electrodes, wherein each axial grouping of electrodes comprises a ring or annular electrode which has been radially segmented into a plurality of electrode segments, the computer program being arranged to cause the control system:

to guide ions through the ion guide.

According to another aspect of the present invention there is provided a computer readable medium comprising computer executable instructions stored on the computer readable medium, the instructions being arranged to be executable by a control system of a mass spectrometer comprising an ion guide comprising a plurality of axial groupings of electrodes, wherein each axial grouping of electrodes comprises a plurality of electrode segments, the computer program being arranged to cause the control system:

(i) to operate the ion guide in a first mode of operation wherein ions are confined radially within the ion guide by a non-quadrupolar radial pseudo-potential well; and (ii) to operate the ion guide in a second mode of operation wherein ions are confined radially within the ion guide by a substantially quadrupolar radial pseudo-potential well.

The computer readable medium is preferably selected from the group consisting of: (i) a ROM; (ii) an EAROM; (iii) an EPROM; (iv) an EEPROM; (v) a flash memory; (vi) an optical disk; (vii) a RAM; and (viii) a hard disk drive.

According to other aspects of the present invention a computer readable medium is provided comprising computer executable instructions stored on the computer readable medium, wherein the instructions are arranged to be executable by the control by the control system of a mass spectrometer may be provided wherein the computer program is arranged to cause the control system to implement one or more of the preferred methods are described above.

According to a preferred embodiment a mass spectrometer is provided comprising an RF ion guide which may be operated in at least two different modes. Switching between the modes may be achieved by altering the phase and/or amplitude and/or frequency of a RF voltage applied to a first set of electrodes relative to a RF voltage applied to a second set of electrodes.

According to the preferred embodiment a single mechanical electrode arrangement is provided wherein when the electrode arrangement is connected to appropriate AC or RF power supplies. The device can be operated in two different modes which may be alternated between by altering the phase, voltage or frequency of the AC or RF voltages applied to some of the electrodes.

According to an embodiment of the present invention an ion guide is provided which is formed from a stack of ring electrodes. Each ring electrode is preferably segmented into four quadrants or multiple segments. According to an embodiment each ring electrode may be segmented into 2, 3, 4, 5, 6, 7, 8, 9, 10 or more than 10 segments. In one mode of operation, RF of the same phase is applied to all four quadrants or all segmented electrodes. RF of the opposite phase is preferably applied to all four quadrants or all segmented electrodes forming an adjacent ring electrode. In this mode of operation, the electric field generated within the ion guide closely approximates the field generated with a non-segmented ring stack i.e. a conventional ion tunnel ion guide comprising a plurality of ring electrodes wherein adjacent ring electrodes are maintained at opposite phases of an RF voltage.

However, by swapping the phase of the RF applied to some of the electrodes such that one phase of RF is applied to one set of diametrically opposed quadrant electrodes and the opposite phase of RF is applied to the other set of diametrically opposed quadrant electrodes on every ring, then the electrical field generated within the ion guide can be made to closely approximate that generated by a quadrupole rod set. According to an embodiment by swapping the RF phase applied to some electrodes enables the device to interchange between two different modes of operation, one which has the characteristics of an ion tunnel ion guide and the other which has the characteristics of a quadrupole rod set.

Other embodiments are contemplated wherein the frequency or amplitude of the RF applied to the electrodes may be altered to affect a similar change in the characteristics of the electric field and hence the properties of the ion guide.

Further embodiments are contemplated where other electrode ensembles are utilised and where the variation in phase, frequency or amplitude of the AC or RF voltages applied to some of the electrodes within the ensemble allows two or more different modes of operation to be accessed.

BRIEF DESCRIPTION OF THE DRAWINGS

Various embodiments of the present invention together with other arrangements given for illustrative purposes only will now be described, by way of example only, and with reference to the accompanying drawings in which.

DETAILED DESCRIPTION OF THE PREFERRED EMBODIMENTS

Figure 1:
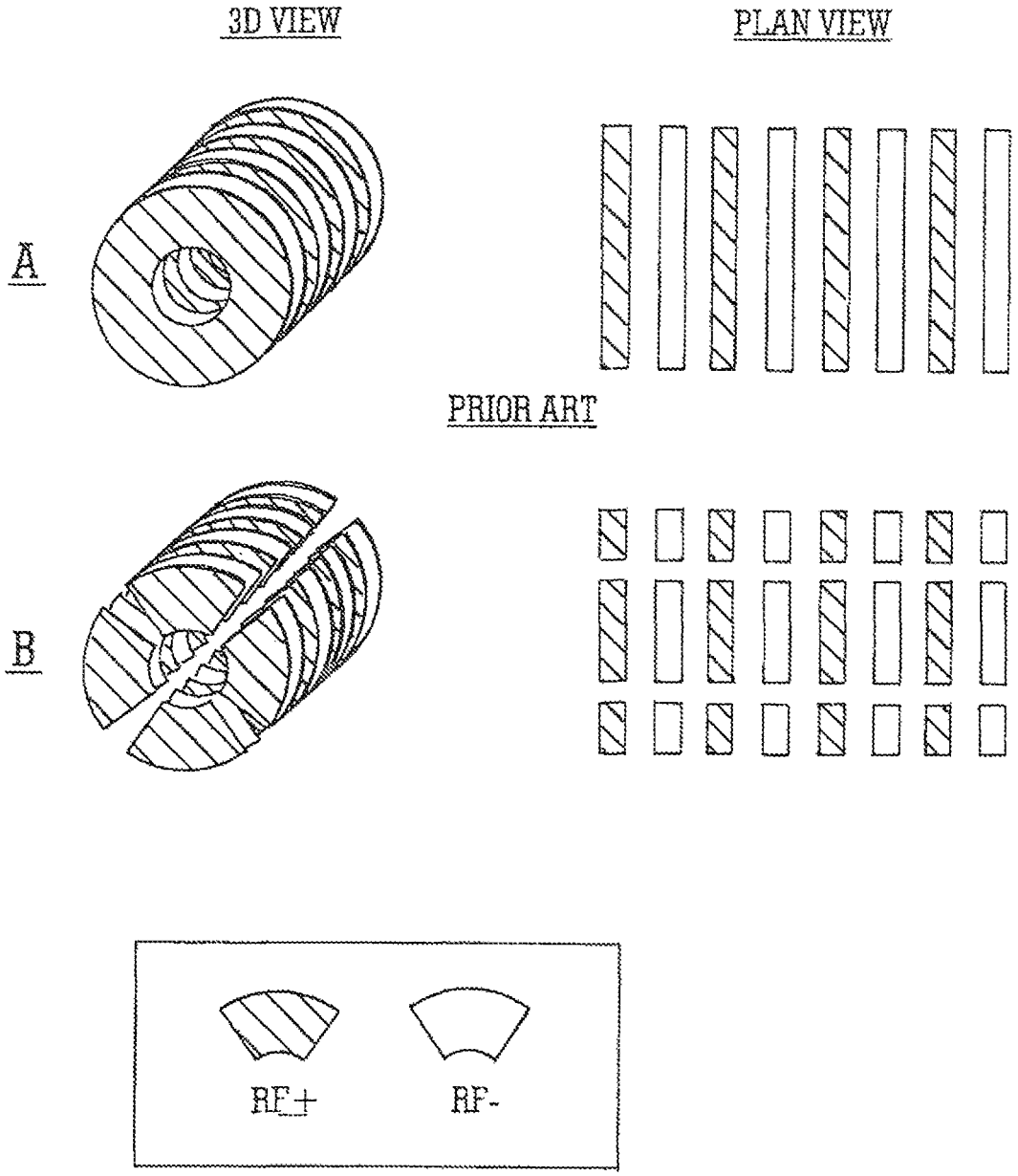
FIG. 1A shows a conventional stacked ring or ion tunnel ion guide and FIG. 1B shows a radially segmented stacked ring ion guide according to an embodiment of the present invention.

A preferred embodiment of the present invention will now be described, FIG. 1A shows a conventional stacked ring ion guide (SRIG). The grey and white shading shown in FIG. 1A indicate the opposite phases of an AC or RF voltage which are applied to adjacent plate electrodes. FIG. 1B shows a radially segmented stacked ring ion guide according to a preferred embodiment of the present invention wherein each ring electrode has been radially segmented into four quadrant electrodes. The confining electric field within the ion guide as shown in FIG. 1B closely approximates that of a conventional stacked ring ion guide as shown in FIG. 1A particularly in the central region of the ion guide.

Figure 2:
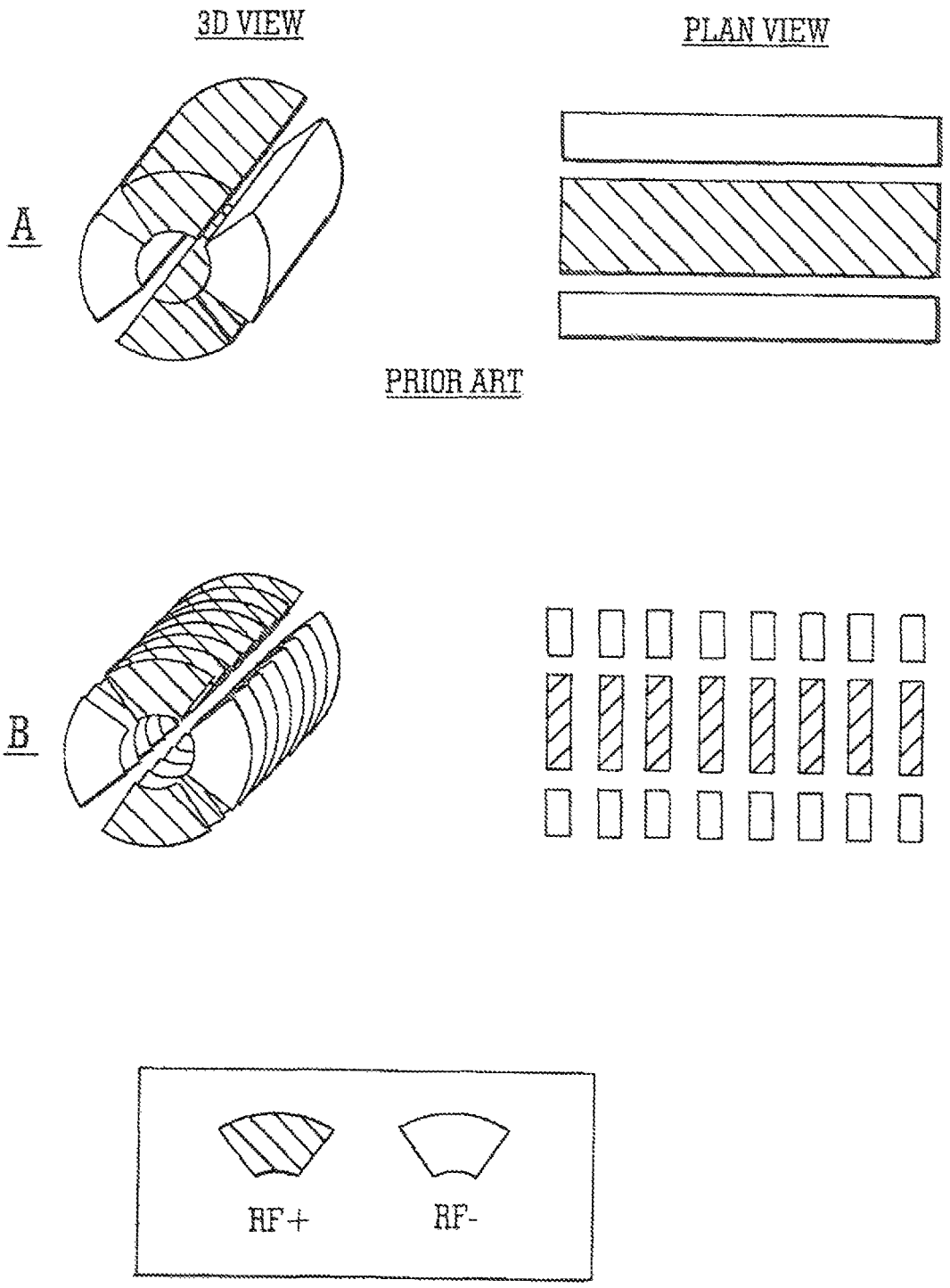
FIG. 2A shows a conventional radially segmented concave rod set and FIG. 2B shows a radially segmented stacked ring ion guide according to an embodiment of the present invention.

FIG. 2A shows a conventional quadrupole rod set ion guide having rods of concave construction. The grey and white shading indicates the opposite phases of an AC or RF voltage that is preferably applied to the electrodes. FIG. 2B shows an embodiment of the present invention wherein a concave rod set as shown in FIG. 2A has been segmented into thin plates and hence structurally is identical to the radially segmented ion tunnel ion guide as shown in FIG. 1B. However, the AC or RF voltages applied to the electrodes differs. The electric field within the ion guide as shown in FIG. 2B closely approximates that of an unsegmented rod set, particularly within the central region of the ion guide.

Figure 3A:
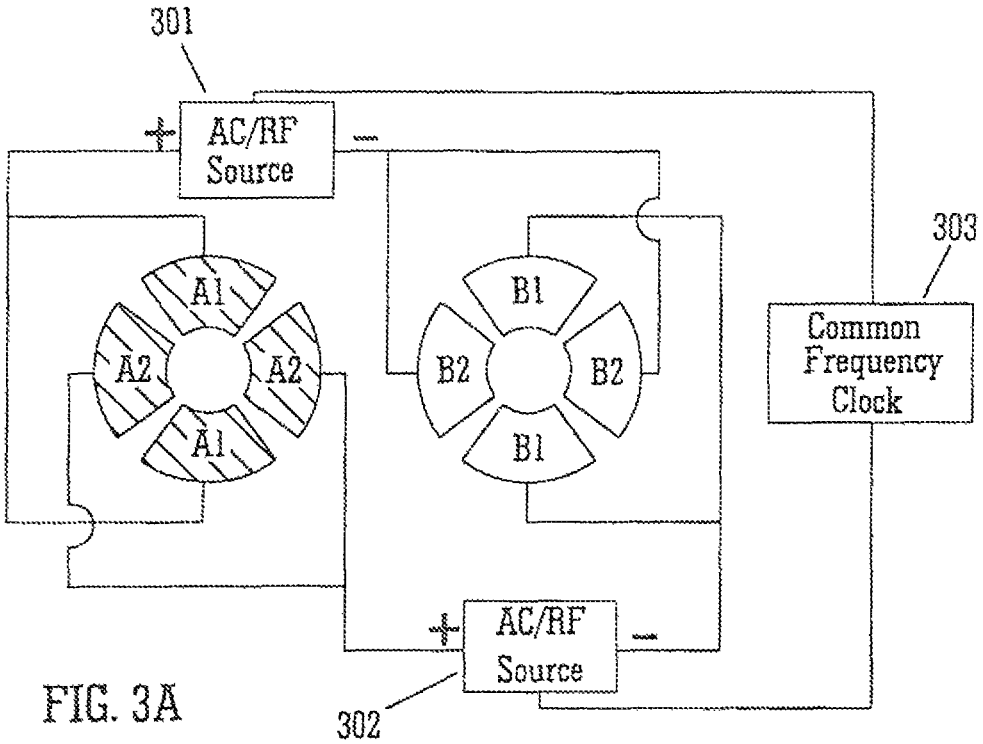
FIG. 3A shows an electrical connection scheme which may be utilised to provide AC or RF voltages to the different lenses of a preferred ion guide according to a mode of operation and FIG. 3B shows an electrical connection scheme which may be utilised to provide AC or RF voltages to the different lenses of a preferred ion guide according to another mode of operation.

FIG. 3A shows an electrical connection scheme according to an embodiment for applying AC or RF voltages to an ion guide as shown in FIG. 1B wherein the appropriate electrical connections are made to each pair of adjacent electrode sets. Two independent AC/RF voltage sources 301 and 302 are provided. Both voltage sources 301,302 are preferably synchronised using a common reference clock 303. In the mode of operation demonstrated in FIG. 3A, positive phase RF voltage is applied to lens elements labelled A1 from first RF voltage source 301 and to lens elements A2 from second RF voltage source 302. Negative phase RF is applied to lens elements B1 from the second voltage source 302 and to lens elements B2 from the first voltage source 301.

Figure 3B:
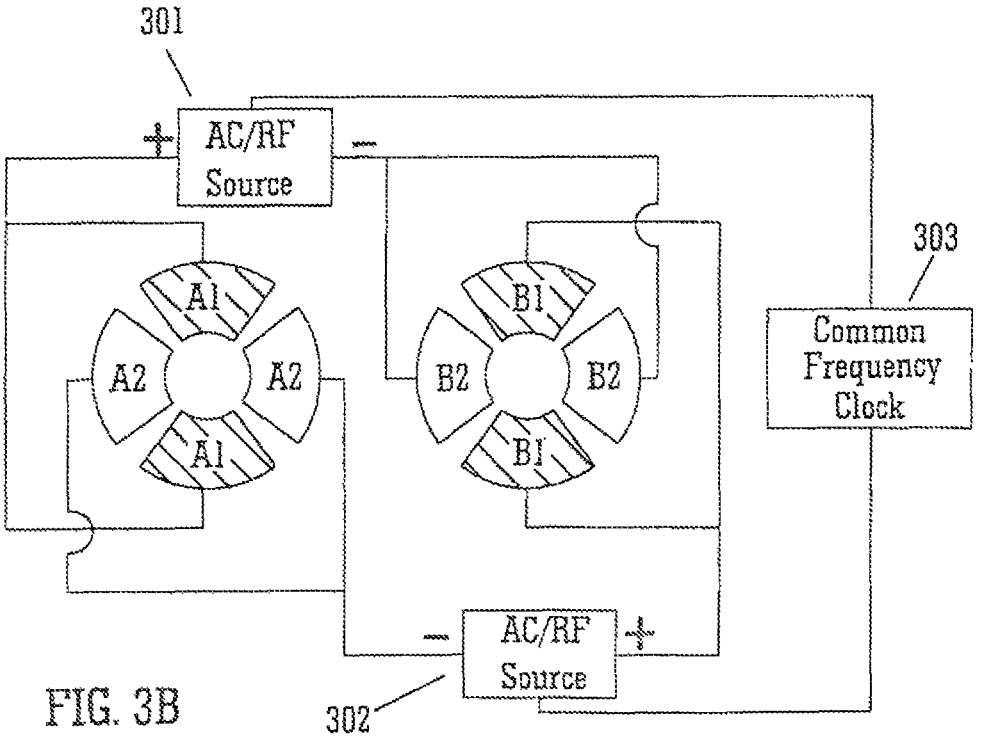

In a second mode of operation as shown in FIG. 3B, the second RF voltage source 302 is caused to swap the phase of the RF voltage which it produces at each output. Positive phase RF is still applied to lens elements A1 from the first RF voltage source 301 but now lens elements A2 are supplied with negative phase RF voltage nom the second RF voltage source 302. Similarly, negative phase RF voltage is still provided to lens elements 132 from the first voltage source 301 but now positive phase RF voltage is provided to elements B1 from the second voltage source 302.

Figure 4:
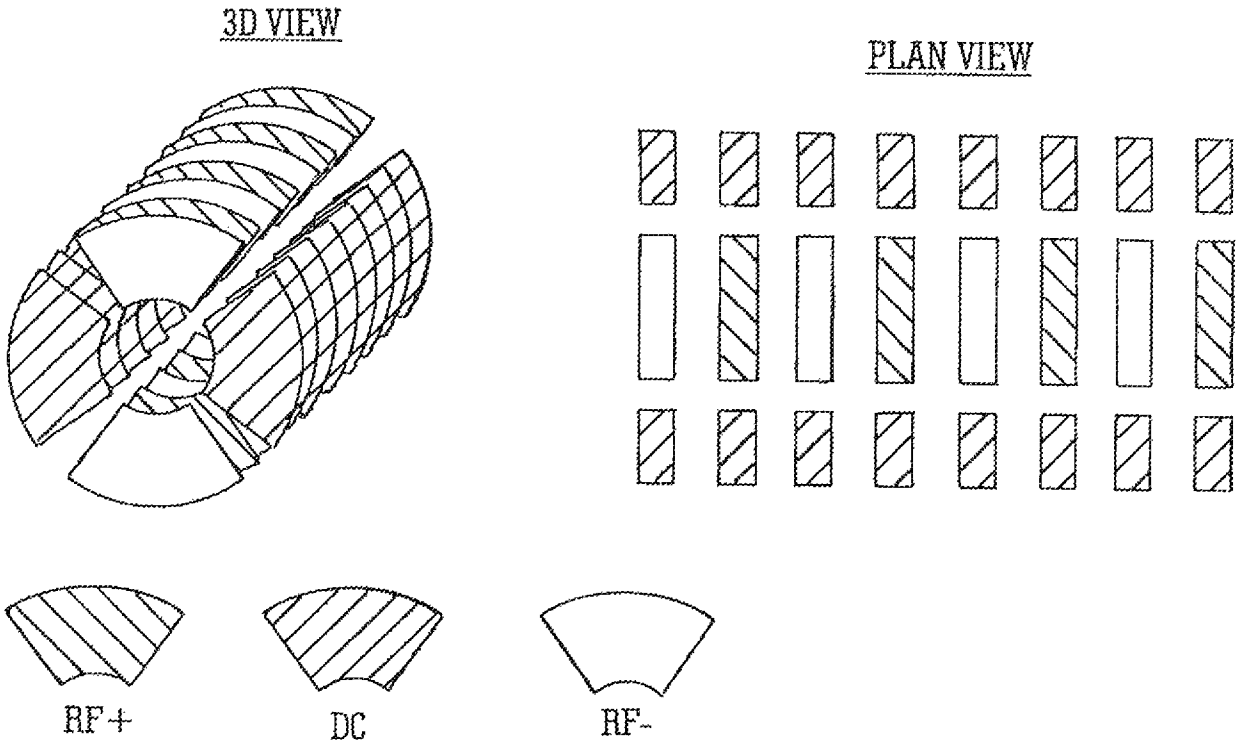
FIG. 4 shows a segmented stacked ring ion guide according to an embodiment of the present invention wherein a combination of RF and DC voltages are applied to the electrodes so as to approximate the electric field produced by a sandwich-plate ion guide.

FIG. 4 shows a further embodiment using the same radially segmented ring stack assembly or ion guide as shown in FIGS. 1B and 2B. However, instead of swapping the phase of the RF applied to some of the electrodes, to move from an approximate ion tunnel geometry to an approximate quadrupole geometry, the amplitude of the RF on some of the electrodes has been reduced to zero and a DC only voltage has been applied to these electrodes. This embodiment approximates the electric field found in a sandwich-plate type ion guide.

Figure 5:
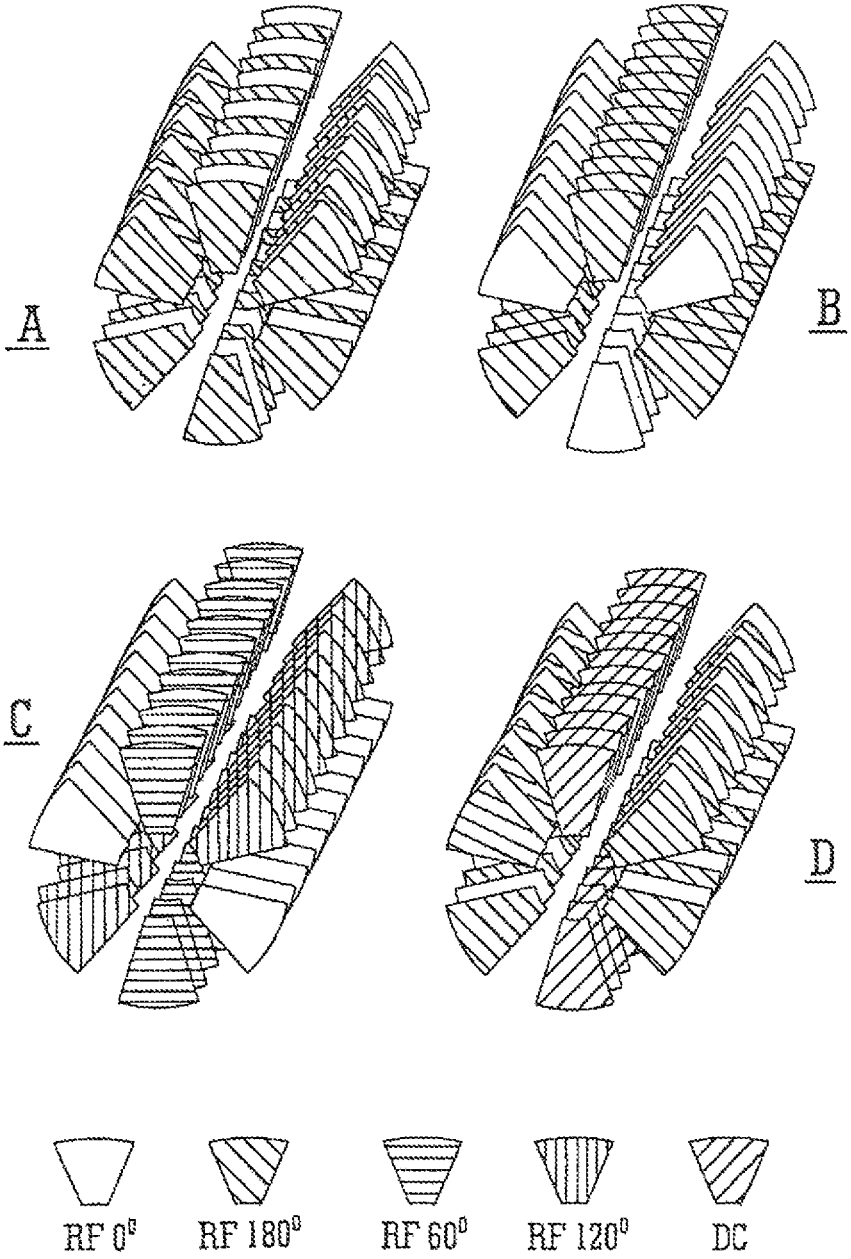
FIG. 5A shows a radially segmented stacked ring ion guide according to an embodiment of the present invention wherein each ring has been segmented into six segments and to which various combinations of RF voltages are applied to the electrodes.
FIG. 5B shows a radially segmented stacked ring ion guide according to an embodiment of the present invention wherein each ring has been segmented into six segments and to which various combinations of RF voltages are applied to the electrodes.
FIG. 5C shows a radially segmented stacked ring ion guide according to an embodiment of the present invention wherein each ring has been segmented into six segments and to which various a three-phase RF voltage has been applied to the electrodes and FIG. 5D shows a radially segmented stacked ring ion guide according to an embodiment of the present invention wherein each ring has been segmented into six segments and to which various combinations of RF and DC voltages have been applied.

FIGS. 5A-5D shows various embodiments wherein a ring stack has been divided or radially segmented into six segments. FIG. 5A shows an embodiment wherein in a mode of operation the same RF phase is applied to all six segments of a particular ring (i.e. to all electrode segments in an axial grouping of electrode segments) and wherein all six segments of an adjacent ring (in an adjacent axial grouping of electrodes) are maintained at the opposite RF phase (i.e. there is a 180° phase shift between axially adjacent ring electrodes and axial groupings of electrodes). In this manner the ion guide approximates a conventional stacked ring or ion tunnel ion guide.

FIG. 5B shows a second mode of operation where the phases of RF voltage applied to some of the electrodes have been swapped such that the electric field within the ion guide approximates that of a conventional hexapole rod set ion guide.

FIG. 5C shows a third mode of operation wherein the phases of RF voltage applied to the electrodes is either 0°, 60° or 120°. This mode approximates a three-phase hexapole rod set ion guide.

FIG. 5D shows a fourth mode of operation where the amplitude of the RF voltage applied to some of the electrodes has been reduced to zero and a DC only voltage is applied to those electrodes. This mode approximates a sandwich-plate ion guide geometry.

Figure 6:
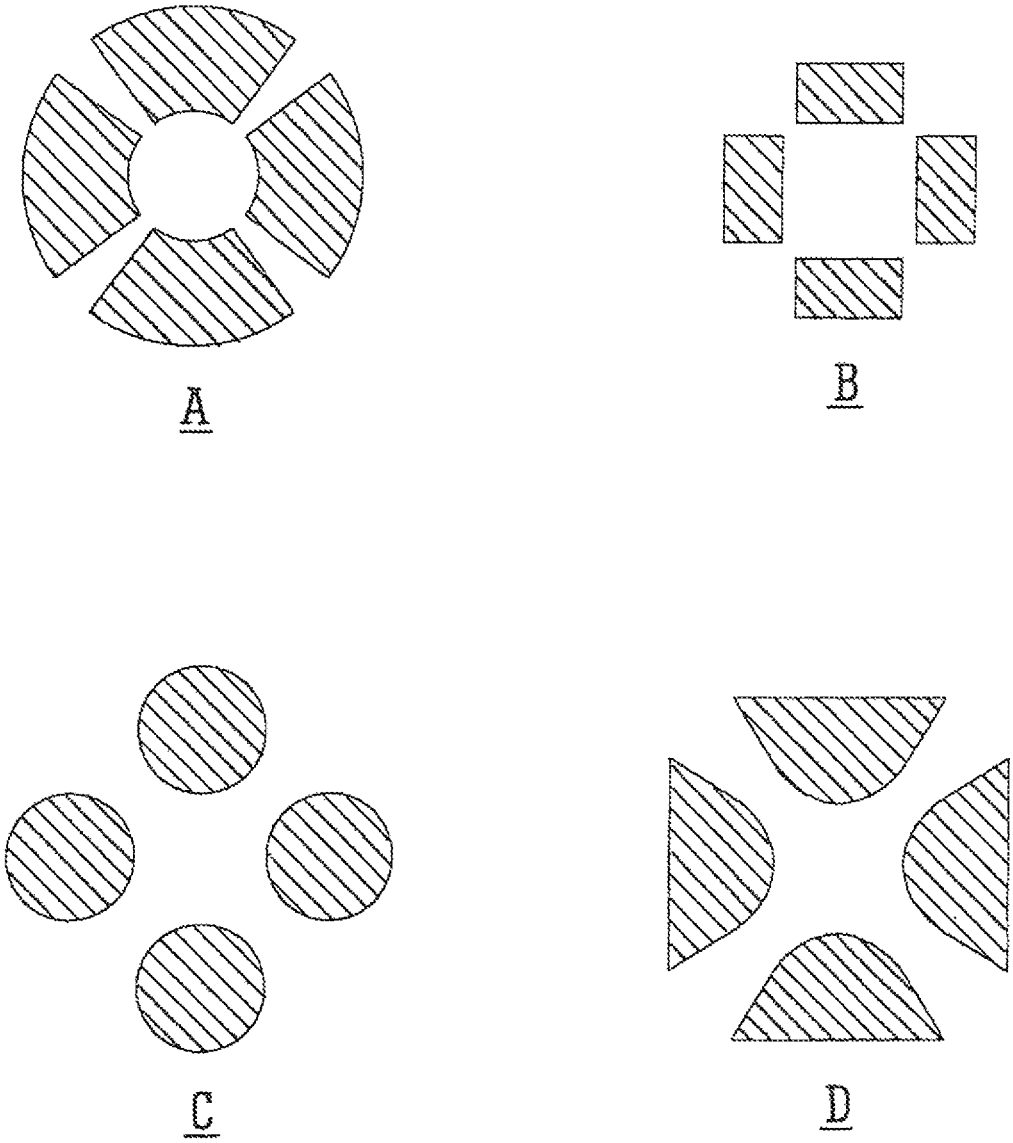
FIG. 6A shows an example of a radially segmented ring electrode profile according to an embodiment of the present invention.
FIG. 6B shows an example of an planar electrode profile according to another embodiment of the present invention.
FIG. 6C shows an example of a circular or rod shaped electrode profile according to an embodiment of the present invention and FIG. 6D shows an example of a hyperbolic electrode profile according to an embodiment of the present invention.

FIGS. 6A-6D provide examples of different electrode structures which may be used according to various embodiments of the present invention. FIG. 6A shows an electrode structure having a ring profile. FIG. 6B shows an electrode structure having a rectilinear profile, FIG. 6C shows an electrode structure having a circular profile and FIG. 6D shows an electrode structure having a hyperbolic profile.

An embodiment is contemplated wherein the device is switched between two modes of operation by means similar to those discussed above such that the ion guide operates in a predominantly transmissive manner in one mode and in a predominantly ion trapping manner in a second mode.

An embodiment is contemplated wherein by moving between the two modes of operation by means similar to those discussed above enables the ion guide to operate in a predominantly transmissive manner with a first transmission characteristic in one mode and with a second transmission characteristic in a second mode. An example of a transmission characteristic includes the stable mass range for ions within the device. Another example is the sharpness of the low mass cut-off of the device.

An embodiment is contemplated wherein both phases of a first AC or RF voltage is applied to an ensemble of electrodes and where a second AC or RF voltage is also applied to some or all of the electrodes. Different modes of operation ma be obtained by varying the phase, frequency or amplitude of either or both AC or RF voltages.

An embodiment is contemplated wherein the AC or RF voltages applied to some of the electrodes may be amplitude modulated (AM) or frequency modulated (FM) relative to the AC or RF voltage applied to other electrodes or to a reference AC or RF source.

Further embodiments are contemplated where various other electrode ensembles may be utilised and wherein the variation in phase, frequency or amplitude of the AC or RF voltages applied to some of the electrodes within the ensemble allows two or more different modes of operation to be accessed. Examples of such electrode ensembles include, but are not limited too, electrodes with non-circular apertures and apertures segmented into less than or more than four quadrants.

Embodiments are contemplated wherein in at least one mode of operation the transmission of the ions through the ion guide depends upon either the ion mobility or the differential ion mobility of the ions or upon the flow of gas through the device.

Embodiments are contemplated whereby in one mode of operation the device acts to transmit ions along one unique path through the device and along a second unique path in a second mode of operation.

Embodiments are contemplated whereby in one mode of operation the device isolates and/or fragments particular ions of interest.

Embodiments are contemplated where the phase shift of the AC or RF applied to some electrodes relative to that applied to other electrodes is between −/−180°.

Further embodiments are contemplated wherein the phase is varied over time.

Embodiments are also contemplated where several of the above embodiments are combined.

Although the present invention has been described with reference to preferred embodiments, it will be understood by those skilled in the art that various changes in form and detail may be made without departing from the scope of the invention as set forth in the accompanying claims.

The invention claimed is:

1. An ion guide comprising a plurality of axial groupings of electrodes, wherein each axial grouping of electrodes comprises a plurality of electrode segments wherein in a first mode of operation ions are confined radially within said ion guide by a non-quadrupolar radial pseudo-potential well whose potential profile is relatively flat bottomed and steep sided and wherein in a second mode of operation ions are confined radially within said ion guide by a substantially quadrupolar radial pseudo-potential well; wherein for each mode of operation voltage phases are selectively applied to individual sets of radial electrode segments of the axial groupings of electrodes.

2. An ion guide as claimed in claim 1, said plurality of axial groupings of electrodes including first, second, third, fourth, fifth, sixth, seventh and eighth axial groupings of electrodes and wherein in said first mode of operation most or all the electrode segments in first or third or fifth or seventh axial groupings of electrodes are maintained at substantially the same first phase of a first AC or RF voltage.

3. An ion guide as claimed in claim 2, wherein in said first mode of operation most or all the electrode segments in second or fourth or sixth or eighth axial groupings of electrodes are maintained at substantially the same second phase of said first AC or RF voltage, wherein:

(a) said second phase is different to said first phase; or (b) the phase difference between said first phase and said second phase is substantially 180°; or (c) the phase difference between said first phase and said second phase is selected from the group consisting of: (i) 0-10°; (ii) 10-20°; (iii) 20-30°; (iv) 30-40°; (v) 40-50°; (vi) 50-60°; (vii) 60-70°; (viii) 70-80°; (ix) 80-90°; (x) 90-100°; (xi) 100-110°; (xii) 110-120°; (xiii) 120-130°, (xiv) 130-140°; (xv) 140-150°, (xvi) 150-160°; (xvii) 160-170°; and (xviii) 170-180°.

4. An ion guide as claimed in claim 2, wherein:

(i) said first axial grouping of electrodes is axially adjacent said second axial grouping of electrodes; and (ii) said second axial grouping of electrodes is axially adjacent said third axial grouping of electrodes;

(iii) said third axial grouping of electrodes is axially adjacent said fourth axial grouping of electrodes;

(iv) said fourth axial grouping of electrodes is axially adjacent said fifth axial grouping of electrodes;

(v) said fifth axial grouping of electrodes is axially adjacent said sixth axial grouping of electrodes;

(vi) said sixth axial grouping of electrodes is axially adjacent said seventh axial grouping of electrodes; and (vii) said seventh axial grouping of electrodes is axially adjacent said eighth axial grouping of electrodes.

5. An ion guide as claimed in claim 2, wherein in a second mode of operation one or more or a pair of electrode segments in said first or second or third or fourth or fifth or sixth or seventh or eighth axial groupings of electrodes are maintained at substantially the same first phase of said first AC or RF voltage and wherein one or more or a pair of electrode segments in said first or second or third or fourth or fifth or sixth or seventh or eighth axial groupings of electrodes are maintained at substantially the same second phase of said first AC or RF voltage.

6. An ion guide as claimed in claim 5, wherein in said second mode of operation:

(a) said second phase is different to said first phase; or (b) the phase difference between said first phase and said second phase is substantially 180°; or (c) the phase difference between said first phase and said second phase is selected from the group consisting of: (i) 0-10°; (ii) 10-20°; (iii) 20-30°; (iv) 30-40°; (v) 40-50°; (vi) 50-60°; (vii) 600-70°; (viii) 70-80°; (ix) 80-90°; (x) 90-100°; (xi) 100-110°; (xii) 110-120°; (xiii) 120-130°; (xiv) 130-140°; (xv) 140-150°; (xvi) 150-160°, (xvii) 160-170°; and (xviii) 170-180°.

7. An ion guide as claimed in claim 5, in said second mode of operation non adjacent electrode segments in said first or second or third or fourth or fifth or sixth or seventh or eighth axial groupings of electrodes are maintained at either said same first phase of said first AC or RF voltage or said same second phase of said first AC or RF voltage.

8. An ion guide as claimed in claim 1, wherein at least some or all of said electrode segments comprise electrodes having a generally quadrant, sextant, octant, planar, rectangular, square, circular, hyperbolic or wedge shape.

9. A method of guiding ions with an ion guide comprising a plurality of axial groupings of electrodes, wherein each axial grouping of electrodes comprises a plurality of electrode segments, said method comprising:

operating said ion guide in a first mode of operation wherein ions are confined radially within said ion guide by a non-quadrupolar radial pseudo-potential well whose potential profile is relatively flat bottomed and steep sided;

operating said ion guide in a second mode of operation wherein ions are confined radially within said ion guide by a substantially quadrupolar radial pseudo-potential well; and selectively applying voltage phases to individual sets of radial electrode segments of the axial groupings of electrodes, for each mode of operation.

* * * * *